United States Patent [19]

Clough et al.

[11] Patent Number: 4,939,647

[45] Date of Patent: Jul. 3, 1990

[54] RE-BREATHER DIVING UNIT WITH OXYGEN ADJUSTMENT FOR DECOMPRESSION OPTIMIZATION

[75] Inventors: Stuart J. Clough, Ellington; Neil M. J. Cave, Huntingdon, both of England

[73] Assignee: Carmellan Research Limited, Nottingham, England

[21] Appl. No.: 215,472

[22] Filed: Jul. 5, 1988

[30] Foreign Application Priority Data

Jul. 3, 1987 [GB] United Kingdom ..... 8715719

[51] Int. Cl.[5] ..... B63C 11/24; B63C 11/26; B63C 11/14

[52] U.S. Cl. ..... 364/413.31; 128/201.27

[58] Field of Search ..... 364/413.31; 73/865.1; 128/201.27

[56] References Cited

U.S. PATENT DOCUMENTS

| | | | |
|---|---|---|---|
| 4,005,282 | 1/1977 | Jennings | 364/413.31 |
| 4,054,783 | 10/1977 | Seireg et al. | 364/413.31 |
| 4,062,750 | 12/1977 | Butler | 204/415 |
| 4,132,516 | 1/1979 | Tantram et al. | 204/415 |
| 4,236,546 | 12/1980 | Manley et al. | 364/413.31 X |
| 4,469,562 | 9/1984 | Chang | 204/1 T |
| 4,658,358 | 4/1987 | Leach et al. | 364/413.31 |
| 4,674,061 | 6/1987 | Diskowski et al. | 364/571 |

FOREIGN PATENT DOCUMENTS

| | | | |
|---|---|---|---|
| 1075814 | 4/1980 | United Kingdom | 364/413.31 |

OTHER PUBLICATIONS

Nishi, R. Y., "Real-Time Decompression Monitoring by Computers", *OED*, vol. 6, Hyperbaric Diving Systems and Thermal Protection Symposium presented at Winter Annual Meeting of ASME, San Francisco, Calif., Dec. 10–15, 1978, 25–38.

*Primary Examiner*—Clark A. Jablon

*Attorney, Agent, or Firm*—Brady, O'Boyle & Gates

[57] ABSTRACT

A mixed-gas, closed circuit, re-breather diving unit (11), and associated diving system and method, having separate supplies (21, 22) of oxygen and inert gas, arranged to feed a breathing loop (23, 25, 26) in such a manner that, in use, oxygen is fed into the loop (23, 25, 26) as it is consumed by a diver, while inert gas is fed into the loop (23, 25, 26) by a water-pressure-sensitive valve (37) to maintain the loop volume, the unit (11) having oxygen partial pressure ($ppO_2$) monitoring sensors (41) whereby the $ppO_2$ is continuously monitored and maintained at a pre-set level below that of the oxygen toxicity threshold, having a depth gauge diaphragm (43) and having carbon dioxide ($CO_2$) scrubber means (23) within the breathing loop (23, 25, 26), and the pre-set level of the $ppO_2$ can, once the $ppO_2$ monitor has been calibrated initially, be reset instantly to another $ppO_2$ pre-set level prior to a dive, and the carbon dioxide level in the breathing loop (23, 25, 26) can be monitored continuously by optional $CO_2$ level sensors (45), and outputs of the $ppO_2$ and $CO_2$ monitoring sensors and of the depth sensor (46) are transmitted via a telemetry link to a surface-located computer programmed to use such output information, together with time information and dive table data, to produce, in real time, a decomposition schedule.

7 Claims, 5 Drawing Sheets

SIGNAL CONDITIONER
VOTING LOGIC
COMPARATOR
PULSE GENERATOR
000000
ELECTROLYTE
+Ve
-Ve
31
32
33
34
35
37
38
301
302
303
1
2
3
4
5
6
7
8
9
10

I C-H DCAP TABLES. A WORKING TIME B C D60NHO.HI2 860ct25

BOTTOM DEPTH (240.) FSW BREATHING GAS (1.4-) ATM DESCENT RATE (30.0) TIME (8.0)

| II BOTTOM TIME | 10. | 15. | 20. | 25. E | (30) | 35. | 40. | 50. | 60. | 90. |
|---|---|---|---|---|---|---|---|---|---|---|
| TO TO 1ST STOP | 6.3 | 5.7 | 5.3 | 5.0 | (4.7) F | 4.7 | 4.3 | 4.3 | 4.0 | 3.7 |

III DEPTH FSW

| DEPTH | | | | | | | | | | | | |
|---|---|---|---|---|---|---|---|---|---|---|---|---|
| 130. | - | - | - | - | - | - | - | - | 0.<br>0. | 6.<br>10. | 130. | |
| 120. | - | - | - | - | - | - | 0.<br>0. | 0.<br>0. | 3.<br>7. | 10.<br>20. | 120. | |
| 110. | - | - | - | - | 0.<br>0. | 0.<br>0. | 1.<br>5. | 5.<br>9. | 10.<br>17. | 10.<br>30. | 110. | |
| G (100.) | - | - | - | 0.<br>0. | H (1.<br>6.) | 4.<br>9. | 4.<br>10. | 10.<br>20. | 10.<br>28. | 10.<br>41. | 100. | |
| I (90.) | - | - | 0.<br>0. | 3.<br>8. | J (5.<br>11.) | 4.<br>13. | 8.<br>18. | 10.<br>30. | 10.<br>38. | 14.<br>55. | 90. | |
| 80. | - | 0.<br>0. | 3.<br>8. | 4.<br>12. | K 4.<br>15. | 8.<br>21. | 10.<br>28. | 9.<br>39. | 10.<br>48. | 17.<br>72. | 80. | |
| 70. | 1.<br>7. | 4.<br>13. | 4.<br>17. | 7.<br>23. | 10.<br>32. | 10.<br>39. | 10.<br>50. | 10.<br>59. | 18.<br>91. | 70. | | |
| 60. | 0.<br>0. | 4.<br>11. | 4.<br>17. | 6.<br>23. | 10.<br>33. | 10.<br>42. | 10.<br>49. | 10.<br>60. | 10.<br>69. | 17.<br>108. | 60. | |
| 50. | 2.<br>8. | 4.<br>15. | 4.<br>21. | 10.<br>33. | 10.<br>43. | 10.<br>52. | 10.<br>59. | 10.<br>70. | 15.<br>84. | 25.<br>133. | 50. | |
| 40. | 4.<br>13. | 4.<br>20. | 10.<br>32. | 10.<br>44. | 10.<br>54. | 10.<br>63. | 10.<br>70. | 12.<br>83. | 17.<br>102. | 42.<br>176. | 40. | |
| 30. | 3.<br>16. | 7.<br>27. | 8.<br>40. | 8.<br>52. | 8.<br>62. | 8.<br>71. | 8.<br>78. | 15.<br>98. | 26.<br>128. | 42.<br>218. | 30. | |
| 20. | 5.<br>21. | 9.<br>36. | 10.<br>50. | 10.<br>62. | 10.<br>72. | 10.<br>81. | 23.<br>101. | 44.<br>142. | 50.<br>178. | 51.<br>269. | 20. | |
| 10. | 13.<br>35. | 13.<br>50. | 12.<br>63. | 18.<br>81. | 38.<br>111. | 59.<br>141. | 63.<br>165. | 64.<br>207. | 64.<br>243. | 64.<br>334. | 10. | |
| 0. | 0.<br>35. | 0.<br>50. | 0.<br>63. | 0.<br>81. | L (0.<br>111.) | 0.<br>141. | 0.<br>165. | 0.<br>207. | 0.<br>243. | 0.<br>334. | | |

FIG. 4.

RE-BREATHER DIVING UNIT WITH OXYGEN ADJUSTMENT FOR DECOMPRESSION OPTIMIZATION

This invention relates to diving systems, and concerns in particular apparatus, systems and methods of operation useful in connection with deep-sea diving.

Commercial deep-sea diving is a mature industry that uses well established techniques which enable divers to work in a reasonably safe and controlled environment at depths down to 500 meters (about 1600 ft) of sea water. There are two categories of diving, characterised by the type of gas breathed by the diver. For depths of less than 50 meters the diver breathes compressed air, which is either fed down a hose from the surface or carried in a tank on the diver's back. As air is readily available to any user, and the diver operates close to the surface, this is a relatively straightforward form of diving.

As a diver proceeds below 50 meters, however, the increasing ambient pressure progressively renders air unbreathable. This is for two reasons: nitrogen, which constitutes approximately 79% of air, becomes narcotic as the pressure at which it is breathed increases; and oxygen, which constitutes some 20% of air, becomes toxic under the same conditions. To overcome this the diver is fed an artificial breathing mix, usually consisting of helium and oxygen. When mixed in the correct proportions such a breathing medium has no detrimental effect on the human body, and allows diving operations to be conducted at any depth that man is physiologically capable of sustaining, which has yet to be fully determined.

The critical factor in artificial breathing mixes is the partial pressure of constituent oxygen ($ppO_2$). Partial pressure is where the total pressure of a gas mix is equal to the sum of the partial pressures which each member gas has and would alone have if the others were absent from the same volume. The physiological effect of oxygen depends upon its partial pressure in a mix, becoming increasingly toxic as this partial pressure increases above the normal level found in air at sea level (approx 0.21 bar—around 3 lbs/sq in). There are two major expressions of oxygen poisoning, one which effects the central nervous system and the other which effects the lungs. Central nervous system (CNS) poisoning becomes a distinct possibility when the partial pressure of inspired oxygen reaches 1.6 bar. It gives rise to various symptoms, the most serious of which is convulsive seizure, similar to an epileptic fit. These seizures last for about two minutes, and are followed by unconsciousness. The sufferer will regain consciousness after some 15 minutes to repeat the symptoms if the oxygen pressure is unchanged. The obvious danger to divers is the loss of control while in the diving environment, and the resultant danger of drowning. Pulmonary oxygen poisoning, on the other hand, results from prolonged exposures to oxygen at partial pressures above 0.5 bar, and causes irritation and damage to the lungs which can be fatal in any environment. The onset of this poisoning is insidious and progressive, and is not as dramatic as CNS poisoning. It should be noted that pulmonary toxicity starts at a far lower $ppO_2$ (0.5 bar) than CNS toxicity (1.6 bar).

It will be apparent from the foregoing that the $ppO_2$ in the breathing mix should be kept to less than 1.6 bar in order to prevent CNS toxicity, and even lower—as low as possible—to reduce long term lung damage. This will be discussed further hereinafter.

A second problem that occurs in diving, and must be considered here, is that of returning safely to the surface after time at any depth. When operating underwater a diver's body absorbs increasing quantities of inert gas (e.g. helium) in proportion to the pressure of that gas and the time spent at depth. A diver must return to the surface at a sufficiently slow rate to allow absorbed inert gas to diffuse safely out of the body tissues as pressure decreases on ascent. If a diver comes up too fast, gas in the body tissues does not have time to diffuse out via the bloodstream and lungs, and instead forms bubbles within the tissues. The effect known as decompression sickness, the so-called "the bends"; it causes a variety of disorders, and can be fatal. The diver must therefore ascend in accordance to a strict decompression schedule determined by the maximum depth and time of any particular dive.

These schedules are widely available in the form of diving tables, published by several research and professional diving bodies. An example of part of a typical schedule is discussed further hereinafter.

It will readily be understood that when artificial breathing mixes are in use the partial pressure of the constituent gases also affects the decompression schedule for a given dive. As it is the inert element of the mix that is absorbed into the tissues, it follows that the less inert gas there is in a mix the less time needs be spent returning to the surface—that is, the shorter the decompression schedule will be. And to lessen the percentage or partial pressure of inert gas more oxygen must be added. Unfortunately, this introduces the dangers of oxygen toxicity.

However, there is scope for a limited amount of optimisation of gas mix for a particular dive. During shallow dives, where absolute pressure is less than $\pm 2$ bar, a diver can breathe pure oxygen, and thus have no decompression requirement. As a diver goes deeper, and the total gas pressure has to be increased, the oxygen content must be reduced to remain below 1.6 bar but nevertheless as close to that value as possible to minimize the inert constituent. Moreover, when time is also considered, which almost invariably it must be, then the $ppO_2$ may have to be further lowered to prevent pulmonary damage and mild CNS symptoms.

By way of example, consider a dive to 300 feet (about 91 m) for a duration (at that depth) of 25 mins. Using a $ppO_2$ of 0.7 bar the total time for decompression would be 326 minutes. On a $ppO_2$ of 1.0 bar, with an appropriately reduced inert gas partial pressure, the decompression time for the same dive would only be 223 minutes. However, for a series of dives on consecutive days the 1.0 bar tables show that the higher $ppO_2$ gives a cumulated oxygen toxicity above acceptable levels sooner than when the lower $ppO_2$ (from the 0.7 bar table) is used for the same series of dives, as oxygen poisoning is cumulative and residual.

The problem, then, is how best and most conveniently to match the partial pressure of both oxygen and inert gas mixture to the depth and duration (both for an individual dive and for a series of dives).

In the late 1970's there was developed a technique using mixed gas, closed circuit re-breather units (though the limitations of this technique rendered it unsuitable for commercial use). Typical of this type of equipment is the Rexnord CCR 155 (originally known as the Seapak 155), of United States manufacture. The unit is worn on the diver's back, and contains in separate bottles a supply of compressed inert gas (e.g. helium) and of oxygen. These gases feed a breathing loop which sustains the diver. Helium is fed into the loop by a water-pressure-sensitive valve to maintain the loop volume as depth increases, and oxygen is added to the loop by an electro-mechanical device as it is consumed by the diver. The oxygen partial pressure of the loop is electronically monitored, and is maintained to a pre-set level below the oxygen toxicity threshold (the oxygen level is pre-set by a lengthy calibration procedure). Carbon dioxide produced by the diver is removed from the breathing loop by a refillable scrubber unit contained within the loop. The scrubber is filled with soda lime granules which absorb carbon dioxide for a limited time span.

There are three major limitations of this system. The most significant is that scrubber performance cannot be accurately predicted. Scrubber failure occurs progressively according to such variables as water temperature, packing density and diver work rate, and gives rise to a build-up of carbon dioxide in the breathing loop which is undetectable by the diver. A high carbon dioxide level may incapacitate the diver, and interferes with the oxygen monitoring devices. A lesser limitation is that a pre-set oxygen level is a compromise that allows safe operations at any depth but is not optimised for all depths where the unit is likely to be used, which affects the length of the decompression schedule. Finally, the calibration procedure may take well over five hours, and so adds substantially to the time and cost of the dive.

The present invention is concerned with the provision of a modified form of mixed-gas closed-circuit re-breather unit wherein the oxygen partial pressure set point is instantly switchable, so allowing the unit's $ppO_2$ to be optimised for whatever depth the diver is intending to work at, wherein the carbon dioxide level is constantly monitored, and wherein the various operating parameters—depth, $ppO_2$ and $CO_2$ level—are fed back to the surface by a telemetry unit. Moreover, the invention is concerned with a diving system using such a modified re-breather unit in association with a computer operating upon dive table data, such that as the dive progress the telemetry-derived depth, $ppO_2$ and $CO_2$ level information, coupled with the time, are fed to the computer which then, in real time, updates the decompression schedule to fit the new circumstances. Finally, the invention is concerned with this just mentioned method of preparing a decompression schedule—that is, by feeding a suitably programmed computer with time, depth, $ppO_2$ and $CO_2$ level information, and having it use this to operate upon dive table data to produce the desired schedule.

In one aspect, therefore, the invention provides a mixed-gas, closed-circuit, re-breather diving unit of the type having separate supplies of (on the one hand) oxygen and (on the other) inert gas, these supplies feeding a breathing loop in such a manner that in use oxygen is fed into the loop as it is consumed by the diver, while inert gas is fed into the loop by a water-pressure-sensitive valve so as to maintain the loop volume, the unit having oxygen partial pressure ($ppO_2$) monitoring means whereby the $ppO_2$ is in use continuously monitored, and maintained at the pre-set level (below the oxygen toxicity threshold), having depth gauge means, and having carbon dioxide ($CO_2$) scrubber means within the breathing loop, wherein the unit additionally includes:

$ppO_2$ set-point means, whereby the pre-set level of the oxygen partial pressure may, once the $ppO_2$ monitor has been initially calibrated, be instantly reset to some other pre-set level prior to a dive;

optional $CO_2$ level monitoring means, whereby in use the carbon dioxide level in the breathing loop may be continuously monitored; and telemetry means, whereby in use the outputs of the $ppO_2$ and $CO_2$ monitoring means, and of the depth gauge means, may be transmitted to a surface-located computer programmed to use this information together with time information and dive table data to produce in real time a decompression schedule.

In another aspect the invention provides a diving system comprising a re-breather unit of the invention (as just defined) together with a computer suitably programmed and supplied with dive table data, and input means enabling the computer in use to be further supplied with time information relating to the dive and the $CO_2$, $ppO_2$ and depth telemetry output of the re-breather unit, whereby the computer is able to produce the desired decompression schedule.

In yet another aspect, the invention provides a method of producing in real time a decompression schedule for a diver, in which a suitably programmed computer is provided with both general dive table data and specific information regarding a dive that is actually in progress, this information including the dive time, the dive depth, and the $ppO_2$ and $CO_2$ levels in the breathing gases supplied to the diver, and uses all this data and information to calculate, and periodically to re-calculate, a decompression schedule suited to the dive conditions the diver has actually experienced up to the calculation point.

The invention relates to the use of a mixed-gas, closed-circuit, re-breather diving unit generally of the Rexnord CCR 155 type mentioned above. Such a unit is conventional in itself, and needs no detailed explanation here (such an explanation is given in the U.S. Navy Diving Manual, at 11-9 to 11-11). Nevertheless, it may summarily be described as follows.

The unit has two tanks of gas. One contains oxygen, the other an inert gas—though most preferably the gas is in fact a mixture of two separate inert gases (typically helium and neon). The inert gas is generally referred to as the "diluent" gas, because it is there solely to dilute the oxygen while maintaining the absolute pressure within the breathing loop.

Each tank of gas feeds its contents into the breathing loop via an appropriate valve and control system. The diluent is fed in via a pressure sensitive valve that (a) allows more in as the diver goes down deeper, and (b) allows breathing mixture out as the diver comes up. The oxygen is fed into the breathing loop to replace that used up by the diver; the amount is controlled by a plurality of $ppO_2$ sensors acting in concert (when the "average" $ppO_2$ drops below the pre-set level, more oxygen is allowed in).

There are usually three $ppO_2$ sensors, and their outputs are (electronically) averaged to provide a value for comparison with the value pre-set as appropriate for the diver's working depth/time. Three sensors, it will be understood, enable the unit to operate properly even it one fails (its output is then ignored)—while two would not (which one's output is wrong cannot be reliably determined), and only one would be too dangerous.

Each sensor is of the type known as a galvanic sensor, in which two electrodes, commonly gold and lead, are disposed in an electrolyte contained within an oxygen-permeable vessel; as oxygen from the breathing loop difuses into the electrolyte so the voltage developed across the electrodes varies in proportion, and can be used to give a direct measure of the $ppO_2$ in the loop. A typical sensor is that known as the 1960 W and available from Normal Air Garrett. The average $ppO_2$ sensor voltage output is compared with the pre-set value, and when it falls below the latter more oxygen is admitted into the loop.

The breathing loop is physically the combination of the diver's face mask, the hoses to and from the face mask, a counter lung, and a $CO_2$ scrubber. The oxygen/diluent exhaled by the diver mixture is passed through the scrubber before being allowed back to the diver; the $CO_2$ exhaled (as the diver uses up the oxygen, replacing it with $CO_2$) is chemically removed within the scrubber.

In general, a $CO_2$ scrubber is a cannister packed with small pellets or granules of a $CO_2$ absorbent such as sodium or lithium hydroxide. This material reacts with $CO_2$ to form the corresponding carbonate, so removing the $CO_2$ from the breathing loop.

The system uses various manual shut-off and/or bypass valves that need not be described further here.

The diver is supplied with several displays (often carried on one or other wrist) to provide an indication of what is going on. Typically, there will be a primary display showing the average $ppO_2$ sensor output (normal, or high or low), and an alarm to indicate failure of any of the sensors, and a secondary display showing both the same average $ppO_2$ sensor output (but now in analogue form—the actual pressure) and the voltage of the battery powering the unit's electronics. In addition, the diver will have conventional depth gauge, and oxygen and diluent pressure gauges, as well as a timepiece.

As regards the depth gauge, this these days is in general a solid state piezoelectric device.

Finally, there is an electronics pack which runs/monitors the various sensors, valves and displays.

The unit of the invention is a modified version of the conventional type of unit just described. Briefly, it has, in addition, resettable $ppO_2$ set-point means, $CO_2$ level monitoring means, and telemetry means.

Perhaps the most important feature of the inventive unit is that it uses $ppO_2$ set-point means whereby the pre-set level of the oxygen partial pressure may, once the $ppO_2$ monitor/sensor has been initially calibrated, be instantly reset to some other pre-set level prior to a dive. In order to appreciate the significance of this it is necessary to bear in mind the nature of the sensor (as described above) and to be aware of how, in present-day equipment, it is calibrated. Basically, the sensor involves a membrane that is permeable to oxygen; on one side (the inside) there is a galvanic cell connected to a suitable electronics package, while on the other (the outside) there is—in use—the breathing mixture. In use, oxygen passes back and forth through the membrane (depending on the "outside" $ppO_2$) causing the galvanic cell to output a greater or lesser signal that is fed to a comparator in the electronics, and when the signal indicates that there is too little a $ppO_2$ outside the electronics outputs a "feed more oxygen in" signal. The system is calibrated by using it in an atmosphere of pure oxygen at some previously determined pressure. If that pressure is atmospheric pressure—thus, 1 bar—then the calibration is relatively simple. However, it will often be that the desired calibration pressure, which depends upon factors such as working depth and time, is either more or less than 1 bar, in which case things become more difficult. Either the calibration must be physically effected at this different pressure—which will necessitate using a pressure chamber of some sort that is itself accurately calibrated—or, if the difference is relatively small, and within the range of the primary display warning system, the latter can, albeit inaccurately, be used to give the required set-point. The first method is inconvenient and cumbersome, the second could be dangerously inaccurate.

The $ppO_2$ level is, as explained above, pre-set to some value that is appropriate to the depth the diver is intending to go, and the length of time to be stayed there. As can readily be understood, all is well provided that the dive plan is not for some reason or other changed after the time-consuming calibration exercise, but all is decidely unwell if either the dive depth or the dive time has to be changed. What is required, then, is a unit where the pre-set $ppO_2$ level can instantly be changed, without a lengthy re-calibration procedure, to some other, more suitable, level—and it is this that the inventive unit provides.

Though there may be a number of ways to achieve this instant re-setability of the $ppO_2$ pre-set level, that preferred for use in the invention involves a modification to the controlling electronics such that there may be selected, by a mere changing of a switch position, a new range of allowable, acceptable, input signal levels centred upon the desired set-point. The ability to achieve this end is dependent upon the output of the $ppO_2$ sensor being essentially linear, so that twice the $ppO_2$ level provides twice the output signal, and so on. As a result, it is possible to construct what is in effect a Wheatstone's Bridge circuit, in which manipulation of the balance of two resistors can restore the Bridge output to a known, usually null, point that indicates the desired set-point and corresponds to the sought-after $ppO_2$ level. Thus, in operation the equipment is first calibrated at leisure at a known, and convenient, $ppO_2$ level—usually 1 bar. Then, knowing that the desired $ppO_2$ level for the dive to be essayed is, say, 1.4 bar, the switch is moved to the 1.4 bar mark, the electronics are now "reset" to 1.4 bar as the operating set-point, and so the whole calibration process is "instantly" effected for that particular dive.

From the above, it will be clear that the switchable oxygen partial pressure facility allows the dive planner to select an optimised oxygen setpoint for a particular dive without having to go through a lengthy calibration procedure. This facility maximises time utilisation in allowing the rapid selection of an oxygen level which will minimise decompression requirements.

When using present-day re-breather units it is not unknown for the efficiency of the $CO_2$ scrubber material to be variable. More particularly, it has been found that, long before the scrubber material should be spent (used up), $CO_2$ gas is *not* being removed from the breathing loop as it ought, so that the $ppCO_2$ becomes dangerously high. It is not entirely clear why this scrubber material variability occurs, but one possibility is that the active material becomes compacted, leaving "empty" volumes around it by which the breathing mixture, with its $CO_2$ content, can exit the scrubber without actually passing through the material at all. To help deal with this problem, the inventive unit optionally—but nevertheless very preferably—includes $CO_2$ level monitoring means whereby in use the carbon dioxide level in the breathing loop may be continuously monitored. Most advantageously the diver will be provided with a display giving a warning if the $CO_2$ level becomes too high.

The monitoring of $CO_2$ is a well-known technique, and the equipment employed in the unit of the invention may be any of the many suitable types. However, the majority of those tend be somewhat bulky, and not entirely suited to use with a self-contained breathing system. Accordingly, it is very preferred, in the present invention, to employ a rather novel type using a semiconductor device, commonly a field-effect transistor, that is slightly permeable to $CO_2$ and whose output is $CO_2$-sensitive. Alternatively, there may be utilised an electro-optical device (a laser diode) whose output is absorbed by $CO_2$ so that the energy falling on a receiving photodiode varies as the $CO_2$ level varies. These sorts of $CO_2$ sensor are currently under development in a number of countries.

In the event of scrubber failure the increasing carbon dioxide level in the breathing loop is detected by the sensor, which activates the alarm light before a dangerous carbon dioxide level is reached. This allows sufficient time for the diver to return to the surface or be provided, while still in the water, with a fresh unit.

The diving unit of the invention is intended to be used, in a system of the invention, in communication with a computer on the surface. In order to achieve that communication, therefore, the unit includes telemetry means whereby in use the outputs of the $ppO_2$ (and optional $CO_2$) monitoring means, and of the depth gauge means, may be transmitted to a surface-located computer programmed to use this information together with time information and dive table data to produce in real time a decompression schedule. The term "telemetry means" here refers both to the apparatus which gathers the data fed in from the various sensor systems and to the equipment which then transmits the data (possibly after some suitable coding) to the surface computer.

The concept of telemetry is very well understood, even when refering to systems intended to operate under water, and the equipment needs no detailed explanation here. Briefly, however, a satisfactory telemetry system continuously digitises and multiplexes the signals input from the chosen sensors, and feeds the coded combination to a transmitter for sending to the surface (where it is decoded and demultiplexed ready for use by the computer). Though the transmitter might employ radio or ultrasound, it is more convenient and reliable to have a physical link—a conductive cable, say, or an optical fibre— between the diver and the surface, so that the system is a "telephone" one.

In its primary aspect the invention provides a novel form of re-breather unit. In a second aspect, however, it provides a diving system comprising such a re-breather unit together with a computer suitably programmed and supplied with dive table data, and input means enabling the computer in use to be further supplied with time information relating to the dive and the $CO_2$, $ppO_2$ and depth telemetry output of the re-breather unit, whereby the computer is able to produce a desired decompression schedule.

The computer may be of almost any type (provided it is capable of holding the required amount of data, accepting real-time inputs, and processing all this information fast enough to give an output in a reasonable time), and will typically be an Apricot or IBM PC (or look-alike) with 640K RAM and a 20MByte hard disk. No more need be said about it here.

The Program controlling the computer is in essence a list of instructions that causes the computer to find the correct sets of data, and perform the appropriate calculations thereupon, and in that sense may be broadly described in terms of what a human would do to achieve the same end. It needs no further comment here—though an example of using the data in the required way is given hereinafter.

The Program controls the computer to produce a decompression schedule according to the factors already described. It operates mainly upon the basis of the well-known mathematical models of the human body (which, basically, see the body as a series of cavities into and out of which gases difuse at different rates) commonly employed in the diving Art and with which Dive Tables are usually generated. The basis for the formulae is work done by J. S. Haldane early in the 1900s, and one presently-used model is that known as the "Tonawanda II" model, the method by which it is applied being referred to as the "Haldane-Workman-Schreiner" method.

Standard dive tables provide schedules for only two variables (time and depth) but the Program's tables introduce two more variables, namely gas type and oxygen partial pressure. The Program has the additional features of providing data for the treatment of decompression sickness relating to this type of diving, monitoring the diver's cumulated oxygen toxicity during a dive where high oxygen levels are used, and documenting the track record of tables and procedures employed.

The diver-mounted telemetry unit transmits (amongst other things) both depth and time data to the surface to enable the rapid updating of the decompression schedule via the computer in the event of any change in the dive profile or predicted variables.

The exact details of the Program are, of course, important for it to run correctly, but are for the most part dependent upon the computer, the language, and the whims of the programmer(s), and therefore need not be discussed further here. It is felt that any competent and professional programmer will be able to write code in a form that the chosen computer can act upon!

It is the primary purpose of the computer/Program combination to provide a decompression schedule for the diver, and it is this that constitutes the third aspect of the invention—namely, a method of producing in real time a decompression schedule for a diver, in which a suitably programmed computer is provided with both general dive table data and specific information regarding a dive that is actually in progress, this information including the dive time, the dive depth, and the $ppO_2$ and $CO_2$ levels in the breathing gases supplied to the diver, and uses all this data and information to calculate, and periodically to re-calculate, a decompression schedule suited to the dive conditions the diver has actually experienced up to the calculation point. The details of this method will be apparent from what has been said already, and need no further comment here.

As will be clear from the foregoing, the diving system of the invention permits the safe use of mixed gas closed circuit re-breather units to any depth. It combines existing technology in a novel and unique manner which overcomes the limitations that previously governed the use of such units. Central to the process is a closed-circuit, re-breather unit of the Rexnord CCR 155 type with modifications to improve its safety and flexibility. These changes consist primarily of a breathing loop carbon dioxide monitoring system and an instantly switchable oxygen partial pressure setpoint. The modified unit is supported by a surface mounted computer which provides a specific dive table for individual divers according to the gas used, the oxygen level selected, the depth, and the time of that dive. To facilitate real-time updates to the dive table in accordance with changing variables, a diver-mounted real-time telemetry unit transmits depth and time data to the surface.

In its various aspects the invention provides three significant advantages over current techniques.

(a) It overcomes the limitation of mixed-gas, closed-circuit re-breathers to provide a safe system for diving to great depths for short durations.

(b) The equipment is highly portable, allowing a three man team with all its equipment to be moved by light helicopter to virtually any location. Once on site, a diver can be rapidly deployed in the water with a gas mix optimised for the task in hand.

(c) The system is highly cost effective for short-duration diving operations, as it requires neither a large support team nor the expensive machinery used in current techniques.

Various aspects of the invention are now described with reference to the accompanying drawings, in which:

FIG. 4 shows a part of some printed Dive Tables showing the type of data used by the invention.

Figure 1:
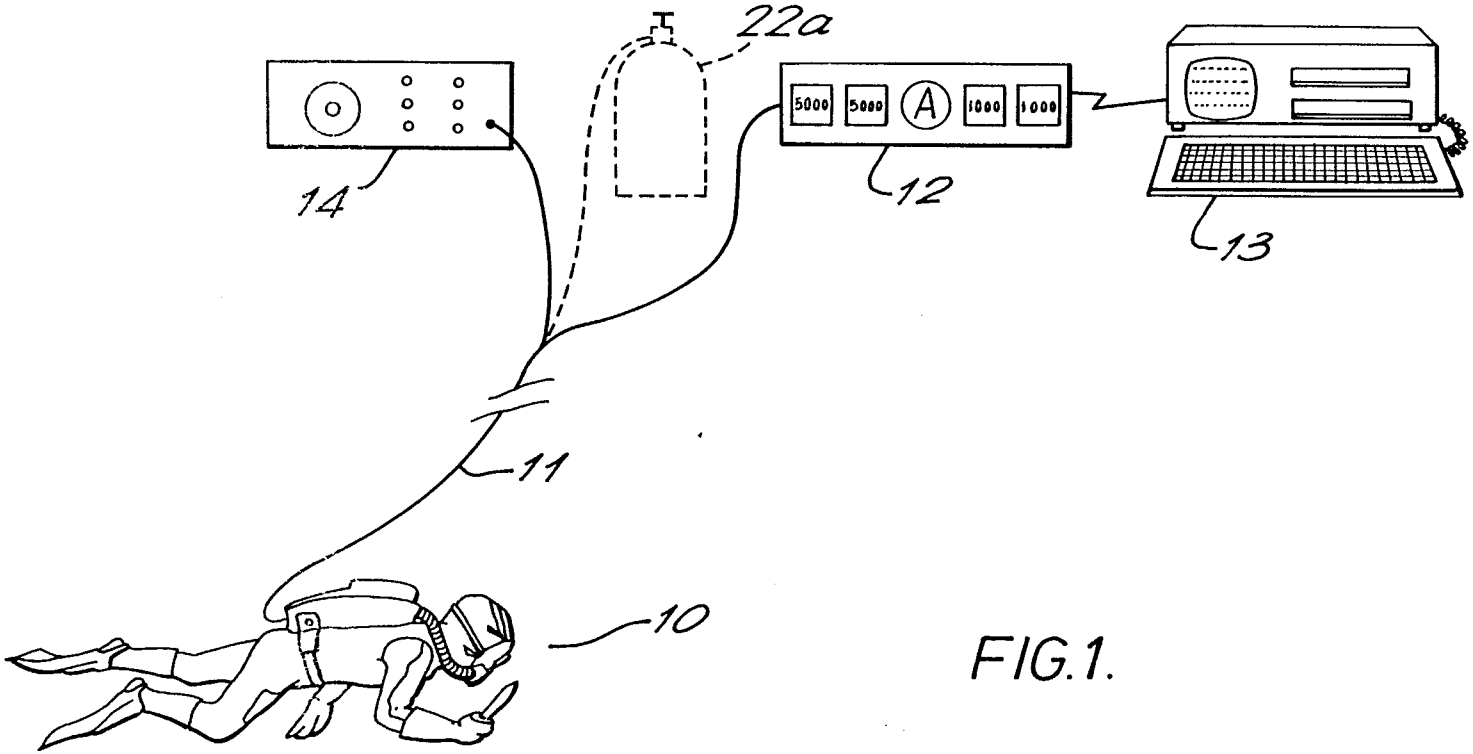
FIG. 1 shows in schematic, pictorial form the whole system of the invention.

FIG. 1 shows in schematic form the main components of the system of the invention. A water-borne diver (10) wears on his back a mixed-gas, closed-circuit, re-breather "aqualung" unit generally of the Rexnord CRR 155 type. Data from instrumentation in the unit is fed up an umbilical telemetry link (11) to equipment on the surface (supported by means not shown); this equipment is basically a data receiver (12), including a demultiplexer and decoder (not shown separately), and a small computer (13). The computer has in store, either in RAM or disk (or some other type of non-volatile storage medium), data about the diver in particular and about diving in general (including standard decompression schedules for various dive depths/times). In accordance with its Program it uses this data, together with other data—diver depth, $ppO_2$, $CO_2$ and time—delivered to it, to generate a decompression schedule specific to this diver on this dive.

The surface equipment also includes a communication unit (14) connected via the umbilical 11 to diver 10, and may include an extra inert gas source (22*a*) also connectable via the umbilical to the diver (this is shown in dashed outline in FIG. 1).

Figure 2:
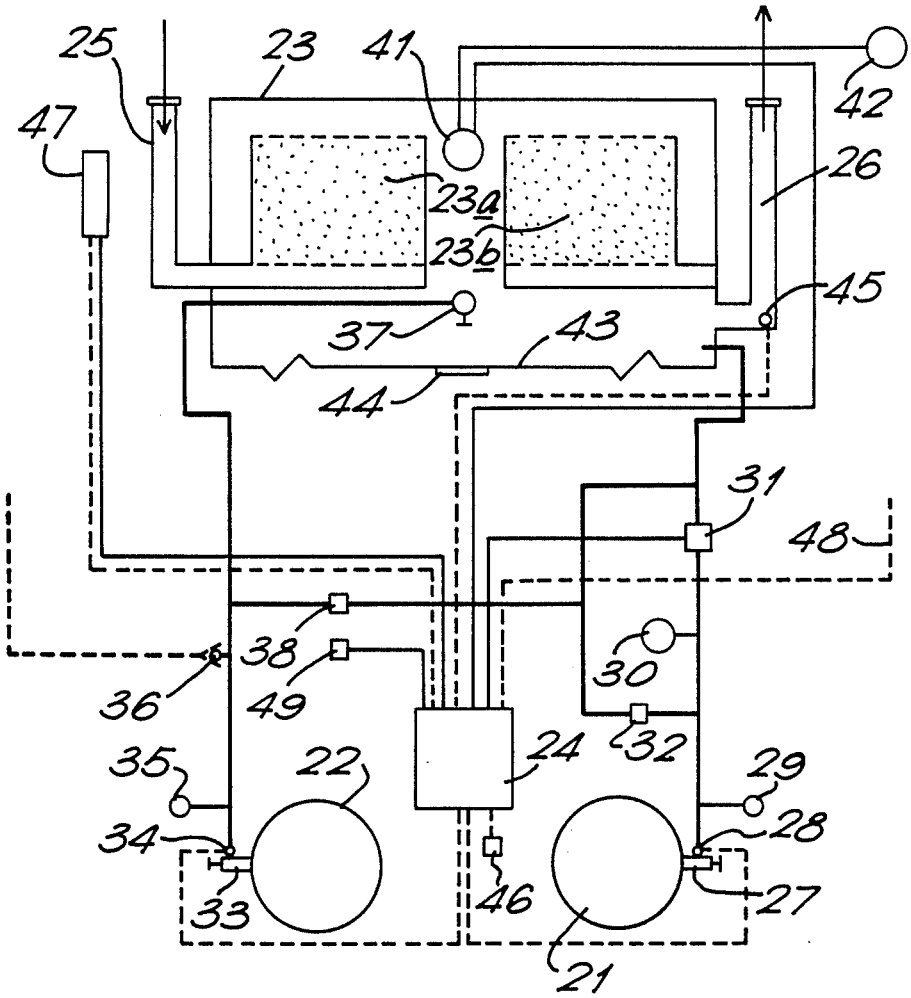
FIG. 2 shows in schematic form the components of the re-breather unit of the invention.

Details of the re-breather unit 11 are shown in FIG. 2, in which the thicker linking lines represent the pneumatic parts of the unit, the lighter linking lines being the electronic parts.

The unit broadly comprises two gas bottles (an oxygen bottle 21 and a diluent bottle 22), a $CO_2$ scrubber (23, containing the actual scrubber chemical packs 23*a*, *b*), an electronic control pack (24), and an assortment of pipes, cables and valves (mentioned individually hereinafter). The breathing loop consists of the scrubber 23, its input (25) and output (26), and the diver's face mask with the hoses connecting it to the scrubber (neither the face mask nor the hoses are shown). Oxygen is delivered to the output side 26 of the scrubber via a bottle shut-off valve (27), a pressure sensor (28), a pressure gauge (29), an accumulater (30) and a solenoid-operated valve (31)—the last two are both bypassed via a manually-operated valve (32). The diluent gas is delivered into the scrubber 23 via a shut-off valve (33), a pressure sensor (34), a pressure gauge (35), an optional non-return valve (36) connected to the optional umbilical diluent supply (22*a* in FIG. 1), and a diaphragm-actuated add valve (37: see below). A manual diluent by-pass valve (38) is provided in a line connecting the diluent/oxygen input lines and by-passing the scrubber 23, so allowing diluent to be fed into the system in the event of scrubber blockage or add valve failure.

The electronic heart of the unit is the control pack 24. This is connected to a variety of sensors and valves throughout the unit, as follows:

An input from the oxygen pressure sensor 28, coupled with inputs from three $ppO_2$ sensors (41) in the scrubber 23, is used to enable the control pack 24 to adjust via the solenoid 31 the $ppO_2$ to match the pre-set value (this value is set just before the dive begins). The $ppO_2$ sensors' outputs are also fed to a display (42) on the diver's wrist.

The pack 24 is also fed with the output from the diluent pressure sensor 34, but does not itself control the diluent supply. This is done automatically by a purely physical arrangement; the scrubber 23 contains a pressure-sensitive diaphragm (43) that moves in or out in response to changes in the pressure differential between the outside environment (the sea, its pressure effect varying as the diver's depth varies) and the inside environment (the breathing loop). The combination of the scrubber 23 container and the diaphragm 43 is usually referred to as "the counter lung". If the outside pressure is the higher (as when the diver is descending) then the diaphragm 43 is pushed inwards and physically contacts and actuates the add valve 37, so allowing diluent into the loop until the inside pressure rises sufficiently (to match that outside), whereupon the diaphragm adopts a "neutral" position, and the add valve 37 is inactivated. When, on the contrary, the inside pressure is the higher (as when the diver is ascending), the diaphragm 43 is pushed outwards and physically contacts and actuates a vent valve (44), so venting the breathing loop to the surroundings, and reducing the inside pressure until it again matches that outside (whereupon the diaphragm re-adopts the "neutral" position).

A $CO_2$ sensor (45) in the scrubber 23 feeds the pack with $ppCO_2$ data.

A depth/time sensor (46) feeds the pack with appropriate data relating to the diver's present depth and the length of time the dive has taken so far.

The pack 24 outputs certain values to a primary display (47) on the diver's wrist. This shows the average $ppO_2$ (in terms of "low", "normal" or "high"), together with a warning light indicating (when on) that the $ppCO_2$ is too high. It may also show other information.

The pack 24 also outputs a variety of information (in digitized, coded, multiplexed form) to the surface via an umbilical telemetry link (48).

Finally, the pack 24 has an on/off switch (49).

Figure 3:
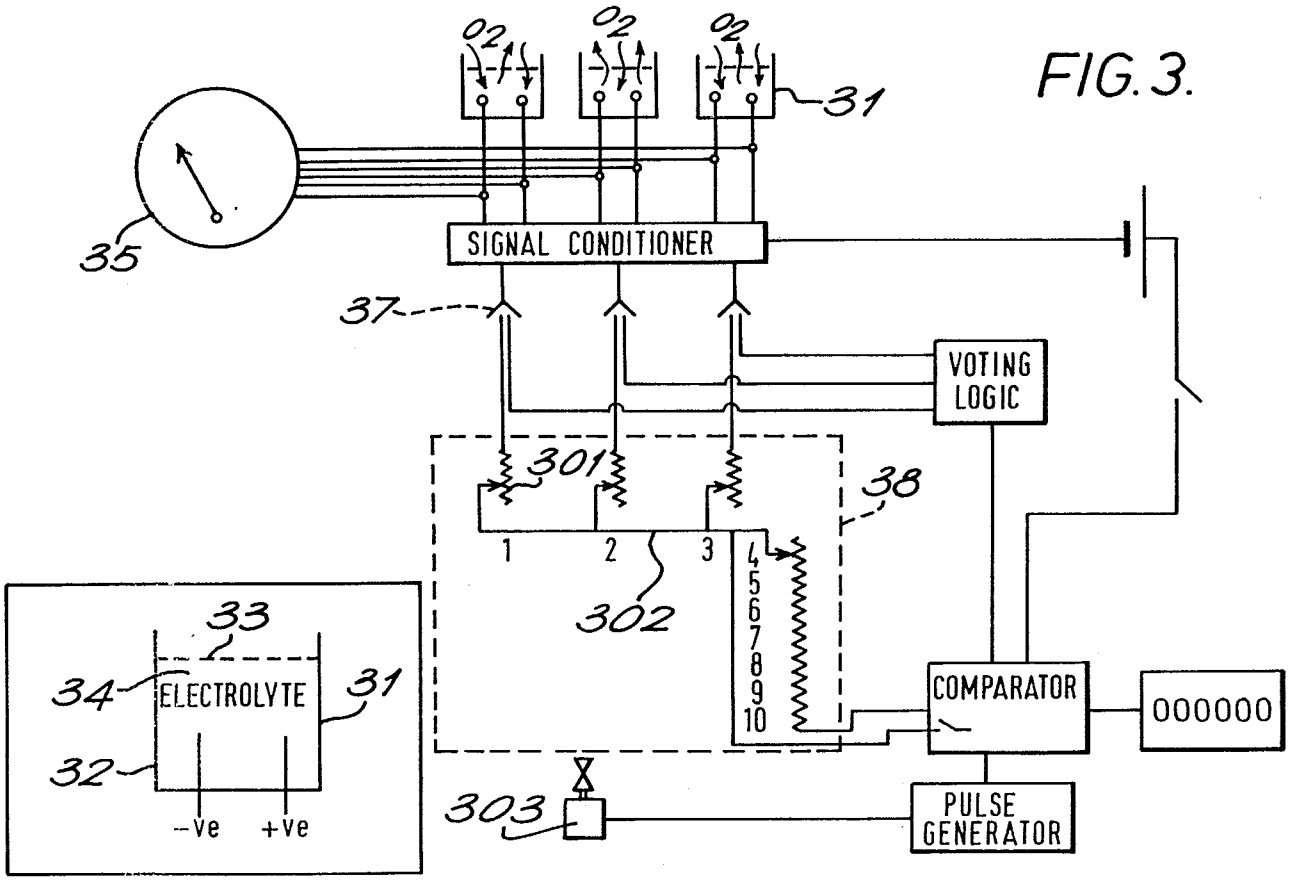
FIG. 3 shows a schematic of a $ppO_2$ set-point apparatus and its associated equipment.

A major feature of the invention is the ability to re-set the pre-set $ppO_2$ set-point without any lengthy recalibration stage. The set-point apparatus enabling this is shown in FIG. 3.

The apparatus is associated with three oxygen sensors (as 31; enlarged in the inset). Each is an electrochemical cell providing a sensing function specific to oxygen. Each unit consists of a non-porous case (32) closed by an oxygen-permeable membrane (33). Enclosed in the case is an electrolyte (34) which bathes a negative cathode and positive anode electrode. The fluid electrolyte absorbs oxygen in direct proportion to the partial pressure of the surrounding oxygen, and its pH value alters depending on its oxygen saturation. The altering pH generates a proportionally altering current across the electrodes. Thus, the sensor generates a specific voltage for a specific oxygen partial pressure. The output from the sensors 31 is sent both to a secondary display (35) and to a signal conditioner (36).

The electronics of the apparatus are calibrated as follows. Output from the sensors 31 enters the signal conditioner 36, which converts the current into a value recognisable by the electronics package (in effect boosts it from ±100 mv to some 10 v). The conditioner's output is then passed on to a switching level (at 37) where, to calibrate the set, the current is directed to Setpoint Control block (38) (for use the output is sent to the Voting Logic block 39). In the setpoint control block 38 each sensor's output passes through a potentiometer (as 301) and thence into a ten-position switch (302). The ten positions correspond to:

1. Measure sensor 1 output
2. Measure sensor 2 output
3. Measure sensor 3 output
4. Low end, setpoint range
5. (+0.2 bar)
6. (+0.2 bar)
7. (+0.2 bar) 0.2 bar increments
8. (+0.2 bar)
9. (+0.2 bar)
10. High end, setpoint range In positions 1–3 the lowest end of the setpoint is automatically selected, and this is the calibrated setpoint position 4. When the switch is moved to position 4 (and higher) itself, the switches 37 automatically direct the signal into the operate mode (this is not shown).

To calibrate the apparatus, the breathing loop is filled with oxygen at sea level pressure, thus providing 1 bar partial pressure of oxygen. The set is switched on. The ten-position switch 302 is turned to position '1'. This causes the electronics to recognise only the signal from sensor 1, and the primary display will light up. Using the sensor 1 potentiometer, the output is adjusted until the green '0' light on the primary display is on. At this point the electronics recognise the signal as the setpoint (and equal to 1 bar $ppO_2$). This is repeated for sensors 2 and 3.

Operation of the apparatus is as follows. Having calibrated each sensor to 1 bar of oxygen, the switch 302 is turned to position 4. This does two things:

(a) it sets the setpoint calibrated to the lowest end of the possible range; and (b) it directs the sensor outputs to the Voting Logic circuit block.

To dive on a setpoint higher than that calibrated at 1 bar, turn the switch 302 to a higher position, which lowers the resistance across a potentiometer and will therefore increase the sensor output recognised as the setpoint. Each position (4 to 10) represents a 0.2 bar step, so if the set is calibrated at 1 bar and one wishes to use a setpoint of 1.6 bar, position 7 is selected.

Once the ten position switch 302 is set, the apparatus is operating. The three sensor outputs are averaged by the voting logic circuit, and the result passes to the comparator. The comparator compares the signal from the voting logic with that selected in the setpoint control, and displays any disparity on the primary display. Additionally, if the voting logic signal (i.e. the $ppO_2$ in the breathing gas) falls below the setpoint, then it signals the pulse generator to open the solenoid valve (303) to make up the oxygen level in the breathing gas.

The comparison between setpoint and actual $ppO_2$ is effected every five seconds or so.

FIG. 4 shows part of a set of dive tables for use with helium/oxygen mixtures and the Rexnord CRR 155 re-breather unit. The significance of the information shown is as follows:

The dive table contains three sets of information consisting of one set of fixed values and two sets of variables.

I. Fixed Values These must be established and adhered to before the rest of the table can be used effectively. Most are determined during pre-dive planning, though depth may not be fixed until the diver reaches his target. The values are:

i. Bottom Depth in feet of seawater (FSW). This is the maximum depth for which this table can be used, and also covers the intermediate levels between this and the previous depth decrement in the tables (220 FSW).

ii. Breathing Gas This is the oxygen setpoint in atmospheres (ATM) to be selected on the rebreather before the diver enters the water.

iii. Descent Rate in feet of seawater per minute. This is the slowest rate at which the diver should descend from surface to target.

iv. Descent Time in minutes. This is simply depth divided by descent rate, and should not be exceeded.

Not shown here, but given in the overall instructions for the entire set of tables for all depths is the ascent rate, which is 30 FSW min, and the diluent gas, either helium or neon or a combination thereof.

II. Bottom Time in minutes. This is the time spent at bottom depth and will vary with the task.

III. Decompression Schedule in minutes at given depth. This varies according to bottom time, and is presented as a "staged" decompression where the diver ascends to a series of "stops" the times of which generally increase as depth decreases.

The action a diver should take to ascend safely from a dive to 240 FSW for a bottom time of 30 minutes breathing 1.4 ATM of oxygen may be described, with reference to the table of FIG. 4, as follows (the relevant figures are ringed in the Figure):

A. Select depth, 240 FSW

B. Set rebreather to 1.4 ATM.

C. Descend from surface at 30 FSW/min for . . .

D. . . . 8 minutes to arrive at 240 FSW.

E. Remain at 240 FSW for up to 30 minutes (or between 25–30 minutes).

F. Leave bottom, and ascend at 30 FSW/min for 4.7 minutes to the first stop (t to 1st stop).

G. The depth of the first stop, 100 FSW.

H. Remain at 100 FSW for upper figure of 1 minute (called "stop time"). At the end of the 1 minute the total time elapsed since leaving bottom should be 6 minutes—i.e., t to 1st stop+first stop.

I. Depth of second stop, 90 FSW.

J. Remain at 90 FSW for upper figure of 5 minutes, at the end of which 11 minutes should have elapsed from leaving bottom—i.e. t to 1st stop+first stop+second stop.

K. Continue staged ascent in above manner until reaching surface.

L. Total elapsed time from leaving bottom,—i.e. t to first stop+all stop times is 111 minutes.

The total dive time is D+E+L,8+30+111=149 Minutes.

Figure 5:
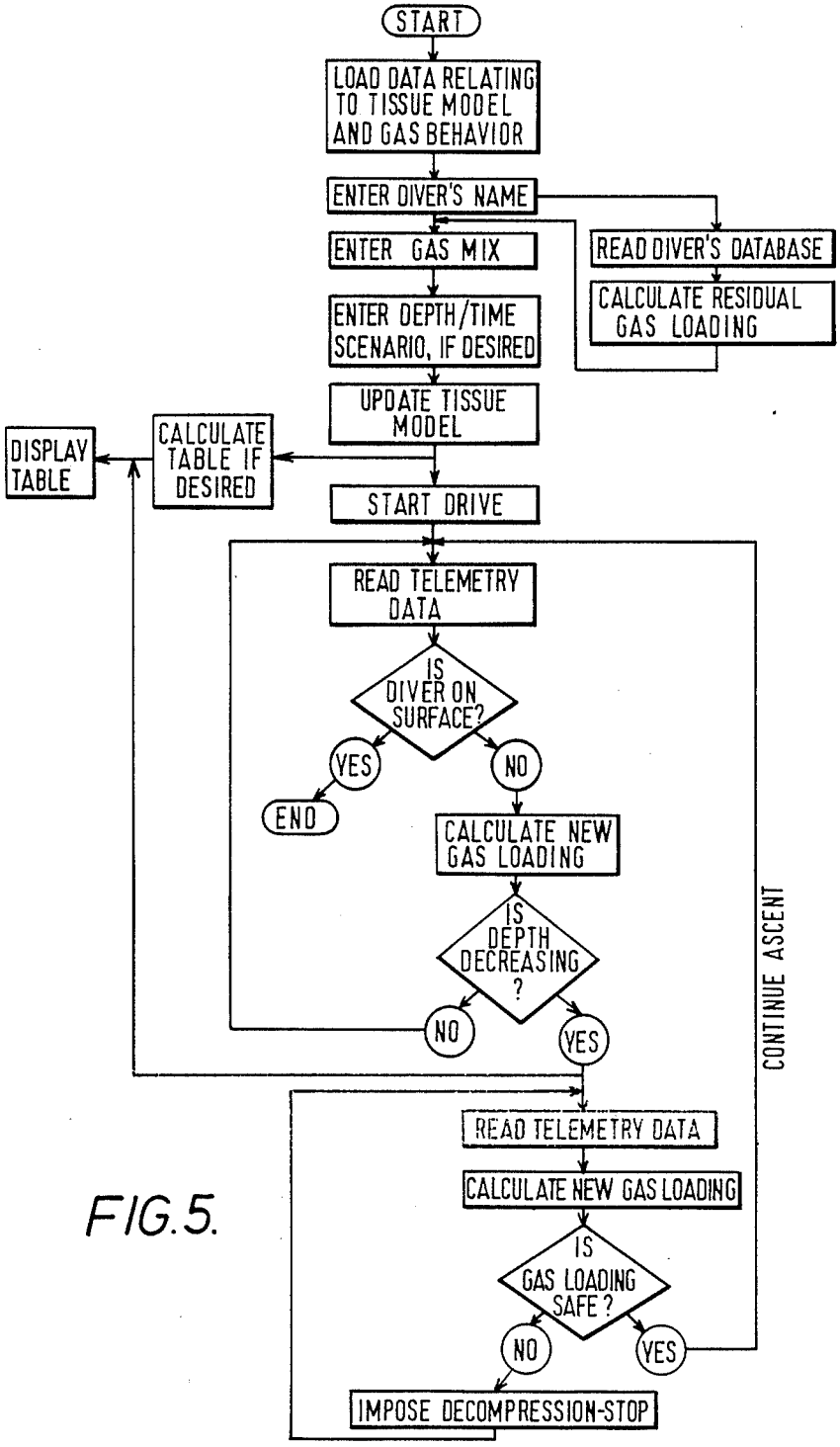
FIG. 5 is a Flow Diagram showing the more important stages in the Computer Program used in the invention.

The computer Flow Diagram of FIG. 5 needs no further comment.

We claim:

1. A re-breather diving unit, comprising a closed circuit breathing loop having a carbon dioxide scrubber for absorbing carbon dioxide exhaled by a diver, oxygen storage means, inert gas storage means, pressure measuring means indicating dive depth, means arranged to supply inert gas into said breathing loop from said inert gas storage means and to allow gas to escape from said breathing loop to maintain the volume of said loop substantially constant, calibratable oxygen measuring means for measuring the partial pressure of oxygen in said breathing loop, manual means for setting a threshold level for the partial pressure of oxygen in said breathing loop after calibration of said oxygen measuring means, means connected for supplying oxygen into said breathing loop from said oxygen storage means to replace oxygen consumed by a diver while, in response to said oxygen measuring means connected thereto, maintaining the partial pressure of oxygen below said pre-set threshold level, and a computer programmed to produce a real-time decompression schedule in response to time, dive table data and inputs from said pressure measuring means and said oxygen measuring means.

2. A re-breather diving unit according to claim 1, including means connected for monitoring the concentration of carbon dioxide in said breathing loop, and means connected to said breathing loop for indicating the presence of high levels of carbon dioxide in said breathing loop.

3. A method of diving, using a re-breather diving unit having a closed circuit breathing loop with a carbon dioxide scrubber for removing exhaled carbon dioxide, oxygen storage means, inert gas storage means, pressure measuring means for measuring dive depth, calibratable means responsive to oxygen partial pressure and a computer programmed to produce real-time decompression-schedule-data, comprising the steps of setting said calibratable means to a desired oxygen partial pressure threshold for a dive, supplying inert gas into said breathing loop during dive descent and allowing gas to escape from said breathing loop during dive ascent, to maintain the volume of said loop substantially constant, supplying oxygen into said loop to replace oxygen consumed by said diver, while maintaining the partial pressure of oxygen below said threshold, and during dive ascent, supplying said measurement of dive depth from said pressure measuring means to said computer, which in turn supplies decompression-schedule-data to the diver.

4. A method according to claim 3, including the steps of monitoring the concentration of carbon dioxide in said loop and indicating the presence of high levels of carbon dioxide indicative of scrubber malfunction.

5. A re-breather diving unit, comprising a closed circuit breathing loop having a carbon dioxide scrubber for absorbing carbon dioxide exhaled by a diver, oxygen storage means, inert gas storage means, pressure measuring means indicating dive depth, means arranged to supply inert gas into said breathing loop from said inert gas storage means and to allow gas to escape from said breathing loop to maintain the volume of said loop substantially constant, calibratable oxygen measuring means for measuring the partial pressure of oxygen in said breathing loop, manual means for setting a threshold level for the partial pressure of oxygen in said breathing loop after calibration of said oxygen measuring means, means connected for supplying oxygen into said breathing loop from said oxygen storage means to replace oxygen consumed by a diver while, in response to said oxygen measuring means connected thereto, maintaining the partial pressure of oxygen below said pre-set threshold level, a surface located computer programmed to produce a real-time decompression schedule in response to time, dive table data and inputs from said pressure measuring means and said oxygen measuring means, and telemetry means connected between said computer and said pressure measuring means and said oxygen measuring means, wherein during operation under water, the computer is located above the surface of said water and receives inputs from said pressure measuring means and said oxygen measuring means via said telemetry means.

6. A method of diving, using a re-breather diving unit having a closed circuit breathing loop with a carbon dioxide scrubber for removing exhaled carbon dioxide, oxygen storage means, inert gas storage means, pressure measuring means for measuring dive depth, calibratable means responsive to oxygen partial pressure and a surface located computer programmed to produce real-time decompression-schedule-data, comprising the steps of setting said calibratable means to a desired oxygen partial pressure threshold for a dive, supplying inert gas into said breathing loop during dive descent and allowing gas to escape from said breathing loop during dive ascent, to maintain the volume of said loop substantially constant, supplying oxygen into said loop to replace oxygen consumed by said diver, while maintaining the partial pressure of oxygen below said threshold, during dive ascent, supplying said measurement of dive depth from said pressure measuring means to said computer, which in turn supplies decompression-schedule-data to the diver, and supplying said decompression-schedule-data to the diver via a telemetry link from said computer.

7. A method according to claim 6, including the steps of monitoring the concentration of carbon dioxide in said loop and indicating the presence of high levels of carbon dioxide indicative of scrubber malfunction.

* * * * *